United States Patent [19]

Tosaka et al.

[11] 4,440,851

[45] Apr. 3, 1984

[54] METHOD FOR THE FORMATION OF A DIRECT POSITIVE IMAGE

[75] Inventors: Yasuo Tosaka; Keiji Ogi, both of Hino, Japan

[73] Assignee: Konishiroku Photo Industry Co., Ltd., Tokyo, Japan

[21] Appl. No.: 433,683

[22] Filed: Oct. 12, 1982

[30] Foreign Application Priority Data

Oct. 22, 1981 [JP] Japan ..... 56-167927

[51] Int. Cl.[3] ..... G03C 7/16

[52] U.S. Cl. ..... 430/378; 430/30; 430/394; 430/409; 430/494; 430/596; 430/940

[58] Field of Search ..... 430/30, 378, 394, 409, 430/494, 596, 940

[56] References Cited

U.S. PATENT DOCUMENTS

| | | | |
|---|---|---|---|
| 2,497,875 | 2/1950 | Fallesen | 430/409 |
| 2,588,982 | 3/1952 | Ives | 430/409 |
| 3,733,198 | 5/1973 | Vanreusel et al. | 430/378 |
| 3,761,266 | 9/1973 | Milton | 430/409 |
| 3,761,276 | 9/1973 | Evans | 430/409 |
| 3,923,513 | 12/1975 | Evans | 430/409 |

*Primary Examiner*—J. Travis Brown

*Attorney, Agent, or Firm*—Jordan B. Bierman; Linda Bierman

[57] ABSTRACT

A method for obtaining direct positive images wherein a photographic material having a support and at least two silver halide emulsion layers coated thereon, each layer having a different spectral sensitivity, said emulsions being of the internal latent image type and containing unfogged silver halide crystals, is imagewise exposed and then subjected to an overall area exposure prior to or during the development thereof to form the image. The overall area exposure is such that the photographic intensity ratios between various layers are not more than 6 and the intensity of such overall exposure has a value between light intensities which give 0.8 times the maximum image density of the particular emulsion layer and 10 times that light intensity value. The photographic intensity ratio is the ratio between photographic intensities of two emulsion layers and the photographic intensity is the reciprocal of the intensity value that corresponds to an image density which is 50% of the maximum when an imagewise-unexposed internal latent type image silver halide emulsion layer is subjected to light-intensity scale exposure and the density of the image formed is measured with a light which corresponds to the absorption maximum of the image.

8 Claims, No Drawings

METHOD FOR THE FORMATION OF A DIRECT POSITIVE IMAGE

This application claims the priority of Japanese patent application No. 167927/1981, filed on Oct. 22, 1981.

The present invention relates to a method for the image formation of a direct positive silver halide light-sensitive photographic material, and more particularly to a method wherein an internal latent image type silver halide light-sensitive photographic material is imagewise exposed and then subjected to a surface development along with an overall exposure to thereby obtain a direct positive color image.

It is generally well-known that a positive photographic image can be formed directly, using a silver halide light-sensitive photographic material, without requiring any intermediate process or any negative photographic image.

Those conventionally known methods for the formation of a positive image by use of a direct positive type silver halide light-sensitive photographic material, aside from special methods, may be broadly calssified into two types:

One type is such that a fogged silver halide emulsion is used, and or the nuclei thereof (latent image) in the exposed area are destroyed by utilizing solarization reversal or the Harschel effect, and then the emulsion is developed to thereby obtain a positive image.

Another type is such that an unfogged internal latent image type silver halide photographic emulsion is used, and the emulsion, after being exposed imagewise, is subjected to a fogging treatment prior to and/or during the surface development thereof, thereby obtaining a positive image.

The above-mentioned internal latent image type silver halide photographic emulsion means such a silver halide photographic emulsion as having a sensitivity speck mainly inside the silver halide particle thereof, thereby a latent image is formed preferentially inside the particle upon exposure to light.

The latter type method is generally highly sensitive as compared to the former type, so that it is suitable for the use that requires a high sensitivity, and the present invention relates to the latter type.

In the field of this art, various techniques have hitherto been known principal examples of which are those as described in U.S. Pat. Nos. 2,592,250, 2,466,957, 2,497,875, 2,588,982, 3,761,266, 3,761,276 and 3,796,577, and British Pat. No. 1,151,363.

The use of these known methods enables the production of relatively highly sensitive light-sensitive photographic materials for the direct positive type.

Regarding the positive image forming mechanism, although the mechanism is hardly taken to have been clearly detailed until now, the process in which a positive image is formed may be comprehended to a certain extent by reading, for example, "an internal image desensitization" as is discussed on P. 161 of the 3rd edition of "The Theory of the Photographic Process" written by both Meese and James.

Namely, the mechanism is considered to be such that the surface desensitization due to the so-called internal latent image produced inside the silver halide particle by the initial imagewise exposure causes a fog nucleus to be selectively produced on only the surface of the unexposed silver halide particle, which surface fog nucleus is then developed by an ordinary surface development to thereby form a photographic image in the unexposed area.

As means for selectively forming fog nuclei as described above there are known two methods: one is the so-called light-fogging method wherein the entire area of a light-sensitive layer is exposed to light to fog, while the other is the so-called chemically-fogging method wherein a fogging agent is used to fog a light-sensitiive layer.

Of the above methods, the chemically-fogging method, since it has such a severe condition that the effect of a fogging agent does not appear until the pH thereof reaches as high as not less than 12, has the disadvantage that the method tends to cause the fogging agent to be deteriorated by the aerial oxidation, and thus the fogging effect is extremely lowered.

On the other hand, the light-fogging method, although practically convenient because it requires no severe condition such as the above, leaves several technical problems in order to be provided for various purposes in the extensive field of photography; that is, the light-fogging method, since it is on the basis of the formation of fog nuclei by the photodecomposition of a silver halide, the appropriate intensity or quantity of exposure depend upon the kind and characteristics of a silver halide to be used.

In the light-fogging method, for example, Japanese Patent Publication No. 12709/1970 describes the uniform exposure of the entire area of an emulsion layer to light of a low intensity. According to the publication, the overall exposure to light of a low intensity enables to obtain a satisfactory direct positive image having both high maximum density and low minimum density.

The application of an internal latent image type direct positive emulsion to a silver halide light-sensitive color photographic material is very useful for the practical use. The conventional color positive image forming process generally applied is such that a silver halide light-sensitive color photographic material, after being exposed imagewise, is subjected to a black-and-white development, the entire area of the material is fogged by an overall exposure or by a fogging agent, and then the fogged material is color-developed to thereby form a color reversal image. However, the color reversal process has the disadvantage that not only is the number of the process steps numerous but the process is very complicated. In contrast, a positive color photographic material in which the internal latent image type direct positive emulsion is used has the favorable characteristic that the processing procedure is so simple that a positive color image can be obtained by only one-time development.

We studied to obtain an image with the use of the light-fogging method by applying an internal latent image type direct positive emulsion to a color photographic material, but the results of the study showed that under the condition of the overall uniform exposure to light of a low intensity as is described in the foregoing Japanese Patent Publication No. 12709/1970, any entirely satisfactory image characteristics were unable to be obtained in the images formed in a plurality of layers. And Japanese Patent Publication Open to Public Inspection (hereinafter referred to as Japanese Patent O.P.I. Publication) No. 137350/1981 describes the use of a high color-rendering fluorescent lamp to perform a light-fogging exposure, but it has been found this has such a disadvantage that this exposure can result in the obtaining of a satisfactory characteristic from one internal latent image type direct positive color photographic material, but cannot result in the same from another. In other words, it has been found that in the case of developing an internal latent image type direct positive color photographic material with the use of a light-fogging process, in order to obtain a satisfactory positive color image, it is necessary to expose the material to light of a relatively low intensity within a limited intensity range. When exposed to light of a lower intensity than the intensity range, any satisfactory maximum density cannot be obtained, while when exposed to light of a higher intensity than the range, not only is the maximum density lowered but the minimum density becomes extremely high, so that the quality of the positive image in the high-light region is extremely degraded. Further, there is a case where the intensity range of an exposure that enables the obtaining of a satisfactory positive image with regard to one photographic layer does not act equally on another layers being different in spectral sensitivities, and in that case, any satisfactory positive image cannot be obtained. The foregoing Japanese Patent O.P.I. Publication No. 137350/1981, in consideration of this, describes the use of a high color-rendering fluorescent lamp, but it has been found that if the characteristic of an internal latent image type direct positive color photographic material to light-fogging exposure varies, it becomes difficult to obtain any satisfactory positive color image.

It is a first object of the present invention to provide a method for obtaining a satisfactory positive color image by a light-fogging process with the use of a positive color photographic material in which an internal latent image type direct positive emulsion is used.

It is a second object of the present invention to provide a light-fogging process that is suitable for the positive color photographic material in which an internal latent image type direct positive emulsion is used.

The above objects may be attained by a method of the formation of a direct positive image wherein a silver halide light-sensitive color photographic material having on the support thereof not less than two silver halide emulsion layers whose respective spectral sensitivities are not the same, said silver halide emulsion being an internal latent image type one containing unfogged silver halide crystals, is imagewise exposed and subsequently subjected to an overall area exposure prior to or during the development thereof to form a direct positive image, characterized in that said silver halide light-sensitive color photographic material is subjected to such overall area exposures that the photographic intensity ratios among said silver halide emulsion layers defined as below are respectively not more than 6, and the intensity of the overall area exposure has the value between the light intensity value interval which gives 0.8 times of the maximum image density of an emulsion layer and 10 times of said light intensity value.

The "photographic intensity" used herein represents such an intensity as capable of having an effective photographically upon a silver halide emulsion layer that has been subjected to overall exposure, and may be determined in the relation of each silver halide emulsion layer. The photographic intensity depends on the energy distribution of the overall exposure as well as on the spectral sensitivity distribution of each silver halide emulsion layer.

A method of determining the photographic intensities is described in detail below:

When an imagewise-unexposed internal latent image type silver halide color photographic material of the present invention, before or during the development thereof, is subjected to an overall area exposure in a light-intensity scale without changing the energy distribution and the density of the image formed by a silver halide emulsion layer having a certain spectral sensitivity is measured with a light corresponding to the maximum absorption by the image, the reciprocal of the intensity value that enables to obtain the ½ of the maximum image density is regarded as the photographic intensity of the overall area exposure to the silver halide emulsion layer. The ratio of two photographic intensities of the overall area exposure between silver halide emulsion layers having different spectral sensitivities is defined as the photographic intensity ratio.

In the present invention, the exposure to be made in a light-intensity scale without changing the energy distribution of the overall exposure (hereinafter referred to as "light-intensity scale exposure") is given before or during the developing process and by changing only the intensity of light that is used in the overall exposure. The light-intensity scale exposure may be made either by changing the intensity of light only if the energy distribution of the light source is not varied or by changing the distance between the light source and the silver halide photographic light-sensitive material. In general, it is the most useful to make the light-intensity scale exposure by utilizing a light-quantity reducing filter.

The period of making a light-intensity scale exposure should be set so as to be equal to the period of making the overall exposure.

Where the overall exposure is made through such a filter, a reflecting plate, or the like as to change the energy distribution of the light source, the light-intensity scale exposure must also be made through the use of the same filter, reflecting plate, or the like.

The silver halide light-sensitive photographic material which is still not exposed imagewise but subjected to a light-intensity scale exposure before or during the development thereof, after completion of the development process, if necessary, may be further treated in succession in a process necessary for the image formation.

If the intensity of the light-intensity scale exposure is less than a given value, the image density is very low. As the intensity of the light-intensity scale exposure is gradually made higher, the image density becomes higher, and when the image density reaches a given intensity level, there appears such a region that even if the intensity is made further higher, the image density no longer increases. Such a dependence of the image density upon the intensity generally varies according to the respective silver halide emulsion layers.

It has been found that when such an overall exposure that the respective ratios between the photographic intensities determined in respect of the plural silver halide emulsion layers are all not more than 6 times is given, a satisfactory image can be obtained. Preferably, such an overall exposure that the respective ratios between the photographic intensities are all not more than 4 times should be given.

The silver halide color photographic material of the present invention has on the support thereof at least two image formable silver halide emulsion layers capable of forming a color image. A preferred example of the present invention is a silver halide color photographic material comprising an yellow image forming blue-sensitive silver halide emulsion layer, a magenta image forming green-sensitive silver halide emulsion layer, and a cyan image forming red-sensitive silver halide emulsion layer. Such a multi-layered silver halide color photographic material is described hereinafter.

If the respective maximum densities obtained by measuring with blue light to the yellow image, with green light to the magenta image, and with red light to the cyan image are regarded as Dmax B, Dmax G, and Dmax R, respectively, and if the intensities of light that provide the values of one second ($\frac{1}{2}$) of them the $\frac{1}{2}$ Dmax B, $\frac{1}{2}$ Dmax G, and $\frac{1}{2}$ Dmax R are regarded as $I\frac{1}{2}$ B, $I\frac{1}{2}$ G, and $I\frac{1}{2}$ R, respectively, then the photographic intensities mentioned in the present invention may be expressed as $1/I\frac{1}{2}$ B, $1/I\frac{1}{2}$ G, and $1/I\frac{1}{2}$ R.

According to the present invention, $$\frac{1}{6} \leqq \frac{I\frac{1}{2}B}{I\frac{1}{2}G} \leqq 6 \quad (1)$$

$$\frac{1}{6} \leqq \frac{I\frac{1}{2}G}{I\frac{1}{2}R} \leqq 6 \quad (2)$$

$$\frac{1}{6} \leqq \frac{I\frac{1}{2}R}{I\frac{1}{2}B} \leqq 6 \quad (3)$$

The present invention may be accomplished by giving an overall exposure having such photographic intensity ratios as satisfying all the above formulas (1), (2) and (3).

The measurements of the image densities in the present invention were made with lights of the wavelengths in the proximity of the respective absorption maximums of the image. To be more concrete, the measurements were made with such respective monochromatic lights as having intensity maximums within 20 nm from the respective absorption maximums of the image.

As the light source intended for use in the overall exposure in the present invention, any light source may be used if it is such that the ratios between the photographic intensities of the light to the respective layers of a silver halide color photographic material to be used are all controllable so as not to become more than 6. For example, a tungsten lamp light, fluorescent lamp light, halogen lamp light, xenon discharge lamp light, mercuryarc lamp light, the sunlight, or the like may be used singly or in combination of some of them.

The ratios between the photographic intensities in the overall exposure may be changed in normal manners so as to satisfy the above-described conditions. For example, the light source's energy distribution itself may be changed or such a filter as a color compensating filter, color temperature conversion filter, or the like may be used.

The overall exposure may be carried out by use of a plurality of light sources. A preferred example is such that different light sources are used as a blue light, green light, and red light, respectively to make an overall exposure. When a plurality of light sources are used, the overall exposure period may be either the same in respect of all the light sources or different according to each of the light sources.

The overall exposure in the present invention may also be carried out in the manner of light-fogging with increasing the exposure illuminance as is described in Japanese Patent O.P.I. Publication No. 51734/1981.

The optimum exposure intensities may be given by determining the exposure intensities in the overall exposure as given below: When the $I\frac{1}{2}$ B, $I\frac{1}{2}$ G, and $I\frac{1}{2}$ R obtained by the light-intensity scale exposure satisfy the foregoing formulas (1), (2), and (3), if the light intensities that provide 0.8×Dmax B, 0.8×Dmax G, and 0.8×Dmax R which are the 80% values of the Dmax B, Dmax G, and Dmax R are regarded as $I_{0.8}B$, $I_{0.8}G$, and $I_{0.8}R$, respectively, then the overall exposure is desirable to be made by the intensities contained in the interval common to the interval between $I_{0.8}B$ and $10\times I_{0.8}B$, the interval between $I_{0.8}G$ and $10\times I_{0.8}G$, and the interval between $I_{0.8}R$ and $10\times I_{0.8}R$, and more preferably in the interval common to the interval between $I_{0.8}B$ and $6\times I_{0.8}B$, the interval between $I_{0.8}G$ and $6\times I_{0.8}G$, and the interval between $I_{0.8}R$ and $6\times I_{0.8}R$.

The determination of the above-described optimum overall exposure intensities is not limited to the light-sensitive material comprising a blue-sensitive yellow image forming layer, green-sensitive magenta image forming layer, and red-sensitive cyan image forming layer.

In the present invention, the meaning of "the respective spectral sensitivities are not the same" is such that the respective spectral sensitivity distributions are not entirely the same, and the respective spectral sensitivities are allowed to be partially overlapped.

In the present invention, the previously mentioned at least two silver halide emulsion layers whose respective spectral sensitivities are not the same are capable of forming images, but the respective images are desirable to be such that the absorption wavelength regions thereof are selected to be less overlapped.

In the present invention, the overall exposure to be made prior to the development means that the overall exposure followed by the imagewise exposure is made in a processing bath or after the processing in the processing bath that is prior to the development. The mentioned processing bath may contain, if necessary, such additives as a reducing material, alkaline agent, restrainer, desensitizer, and the like.

In the case of making the overall exposure during the developing process, the overall exposure in the initial stage of the process is desirable with respect to saving development-time, and in that case, it is advantageous to commence the exposure upon the sufficient permeation of the developer liquid into the emulsion layers.

The surface developer for use in the present invention means a developer substantially containing no silver halide solvent. Those developing agents usable in the surface developer include normally applicable silver halide developing agents such as polyhydroxybenzenes like hydroquinone, aminophenols, 3-pyrazolidones, ascorbic acid and derivatives thereof, reductones, phenylenediamines, and the like or mixtures of these compounds. To be more concrete, hydroquinone, aminophenol, N-methyl-aminophenol, 1-phenyl-3-pyrazolidone, 1-phenyl-4,4-dimethyl-3-pyrazolidone, 1-phenyl-4methyl-4-hydroxymethyl-3-pyrazolidone, ascorbic acid, N,N-diethyl-p-phenylenediamine, diethylamino-o-toluidine, 4-amino-3-methyl-N-ethyl-N-(β-methane-sulfoneamido-ethyl)aniline, 4-amino-3-methyl-N-ethy-N-(β-hydroxyethyl) aniline, 4-amino-3-methyl-N,N-diethyl-p-phenylenediamine, 4-amino-3-methyl-N-ethyl-N-β-methoxyethyl-p-phenylenediamine, and the like. These developing agents may also be incorporated in the emulsion so as to induce development upon the immersion of the emulsion layer in a high pH aqueous solution.

The surface developer may also contain such additives as antifoggants, development restrainers, and the like. These additives intended for use in developers may also be arbitrarily incorporated into any layers of the light-sensitive photographic material. Those generally usable antifoggants include benzotriazoles, benzimidazoles, benzothiazoles, benzoxazoles, heterocyclic thions such as 1-phenyl-5-mercaptotetrazole, aromatic or aliphatic mercapto compounds, and the like. Further, the developer may also contain such development accelerators as polyalkylene oxide derivatives, quaternary ammonium salt compounds, and the like.

The method for the formation of a direct positive color image of the present invention is applicable also to such color image transfer processes, color diffusion transfer processes, absorption transfer processes as described in U.S. Pat. Nos. 3,087,817, 3,185,567 and 2,983,606 of Rodgers, U.S. Pat. No. 3,253,915 of Weyerts et al, U.S. Pat. No. 3,227,550 of Whitmore et al, U.S. Pat. No. 3,227,551 of Barr et al, U.S. Pat. No. 3,227,552 of Whitmore, and U.S. Pat. Nos. 3,415,644, 3,415,645 and 3,415,646 of Land, in addition to those light-sensitive color photographic materials for general use.

The internal latent image type silver halide emulsion of the present invention is an emulsion that forms a latent image mainly inside the silver halide particle thereof and has most of the sensitivity specks inside the particle thereof, and whose silver halide includes such arbitrary silver halides as silver bromide, silver chloride, silver chlorobromide, silver iodobromide, silver chloroiodide, and the like.

The internal latent image type silver halide crystal is desirable to have the surface thereof not chemically sensitized or, even if sensitized, the degree of sensitization is very slight.

In the present invention, the meaning of "the surface of the silver halide crystal is unfogged" is such that the density obtained by processing without exposing to light a test piece prepared by coating on a transparent support the emulsion for use in the present invention so tht the coated silver amount is 35 mg Ag/dm$^2$ in a surface developer (A) having the following composition for 10 minutes at 20° C. does not exceed 0.6, and preferably does not exceed 0.4.

| Surface developer (A) | |
|---|---|
| Metol | 2.5 g |
| l-Ascorbic acid | 10 g |
| $NaBO_2$—$4H_2O$ | 35 g |
| KBr | 1 g |
| Water to make | 1 liter |

The silver halide emulsion in the present invention provides a sufficiently high density when a test piece prepared in the manner described above is exposed to light and then processed in an internal developer (B) having the following composition:

| Internal developer (B) | |
|---|---|
| Metol | 2 g |
| Sodium sulfite (anhydrous) | 90 g |
| Hydroquinone | 8 g |
| Sodium carbonate (monohydrated) | 52.5 g |
| KBr | 5 g |
| KI | 0.5 g |

-continued

| Internal developer (B) | |
|---|---|
| Water to make | 1 liter |

To put it more concretely, the silver halide emulsion of the present invention shows, when a part of the foregoing test piece is exposed to light in a light-intensity scale for a given period of up to about 1 second and then developed with a surface developing solution (A) for 4 minutes at 20° C., such maximum density that is not greater than one-fifth, preferably one-tenth of the maximum density obtained by subjecting another part of the test piece to exposure in the same manner as above and to the development with an internal developing solution (B) for 4 minutes at 20° C.

To be concrete, the silver halide emulsion applicable to the present invention includes, for example, those conversion type silver halide emulsions as described in U.S. Pat. No. 2,592,250; those internal chemical sensitizing nucleus or multivalent metallic ion-doped core/-shell type silver halide emulsions as described in U.S. Pat. Nos. 3,761,266 and 3,761,276; those multilayered type silver halide emulsions as described in Japanese Patent O.P.I. Publication Nos. 8524/1975, 39525/1975 and 2408/1978; those emulsions as described in Japanese Patent O.P.I. Publication Nos. 156614/1977 and 127549/1980, and the like.

The silver halide emulsion in the present invention may be optically sensitized by the addition of sensitizing dyes in common use. Combined use of those sensitizing dyes intended for use in the supersensitization of internal latent image type silver halide emulsions, negative type silver halide emulsions, and the like is also useful for the silver halide emulsion of the present invention. For those sensitizing dyes, reference can be made to Research Disclosure No. 15162.

The silver halide emulsion of the present invention, in order to make the surface sensitivity thereof as low as possible, and to provide the emulsion with lowest possible minimum density as well as with best possible stable characteristics, may contain stabilizing agents in common use such as, for example, azaindene compounds and heterocyclic mercapto compounds (exemplified by 4-hydroxy-6-methyl-1,3,3a,7-tetrazoindene and 1-phenyl-5-mercaptotetrazole, respectively).

For the silver halide emulsion of the present invention, as antifoggants or stabilizers, for example, triazole compounds, benzothiazole compounds may be used.

To the silver halide emulsion of the present invention various photographic additives may be arbitrarily added: as a wetting agent, for example, dihydroxyalkane may be used; as an improving agent for physical properties of gelatin layers there may be suitably used as aqueous-dispersible particulate macromolecular material obtained by the emulsion polymerization of, e.g., alkyl acrylate or alkyl methacrylateacrylic acid or methacrylic acid copolymer, styrene-maleic acid copolymer, styrene-maleic anhydride-half-alkyl ester copolymer, and the like; as a coating aid, e.g; saponin, polyethylene glycol lauryl ether, or the like may be used; and as other photographic additives, gelatin plasticizers, surfactants, ultraviolet absorbing agents, pH adjusting agents, antioxidation agents, antistatic agents, viscosity increasing agents, graininess improving agents, dyes, mordants, brightening agents, developing rate control agents, matting agents, and the like may be used, if required.

The silver halide emulsion prepared in such a manner as has been mentioned above is coated, if necessary, with a subbing layer, antihalation layer, filter layer, etc. on a support, whereby an internal latent image type silver halide light-sensitive photographic material is obtained.

The light-sensitive photographic material in the present invention may contain in at least three internal latent image type silver halide photographic emulsion layers thereof cyan, magenta and yellow dye forming couplers, respectively.

Among these couplers the yellow dye forming coupler is a benzoyl acetanilide type, pivaloyl acetanilide type or a two-equivalent type yellow dye forming coupler wherein the carbon atom in the coupling position is substituted by a substituent (the so-called split-off group) that can be eliminated during the coupling reaction; the magenta dye forming coupler is a 5-pyrazolone, pyrazotriazole, pyraolinobenzimidazole, indazolone or split-off group-having two-equivalent type magenta dye forming coupler; and the cyan dye forming coupler is a phenol, naphthol, pyrazoloquinazolone or split-off group-having two-equivalent type cyan dye forming coupler.

Further, in order to prevent these dyes from a possible discoloration thereof due to the active rays in short wavelength regions, the use of ultraviolet absorbing agents such as thiazolidone, benzotriazole, acrylonitrile, benzophenone compounds may be useful; particularly the single or combined use of TINUVIN-PS, −320, −326, −327, and −328 (all manufactured by Ciba Geigy, A.G.) is advantageous.

The support for the silver halide light-sensitive photographic material to be used in the present invention may be of an arbitrary material. Typical materials usable for the support includes subbing layer-if-necessary-coated polyethylene terephthalate film, polycarbonate film, polystyrene film, polypropylene film, cellulose acetate film, glass, baryta paper, polyethylene-laminated paper, and the like.

As the hydrophilic binder material for use in the photographic component layers such as emulsion layers, interlayers, filter layers, backing layers, protective layer, and the like of the silver halide light-sensitive photographic material to be used in the present invention, in addition to gelatin, appropriate gelatin derivatives may be used according to purposes. The appropriate gelatin derivatives include, e.g., acylated gelatin, guanidylated gelatin, carbamylated gelatin, cyanoethanolated gelatin, esterified gelatin, and the like. And according to purposes other hydrophilic binder materials in common use may also be contained, and, further, the above hydrophilic binder may contain a plasticizer, lubricant, and the like.

The photographic component layers of the silver halide light-sensitive photographic material may be hardened by an arbitrary hardener. Those hardeners applicable to the light-sensitive material include, e.g., chromium salts, zirconium salts, aldehyde compounds such as formaldehyde, mucohalogenic acid, etc., halotriazine, polyepoxy, ethylene-imine, vinylsulfone, acryloyl hardener, and the like.

Further, the light-sensitive photographic material in the present invention may have on the support thereof a plurality of various photographic component layers such as emulsion layers, filter layers, interlayers, protective layer, subbing layer, backing layer, antihalation layer, and the like.

The present invention is described in reference to examples below, but the embodiment of the present invention is not limited thereto.

EXAMPLE 1

In accordance with the method as described in Japanese Patent O.P.I. Publication No. 127549/1980, an internal latent image type silver halide emulsion was prepared: that is, to 220 ml of a 1 mol/l aqueous potassium chloride solution containing 10 g of gelatin were quickly added 200 ml of a 1 mol/l aqueous silver nitrate solution at 60° C. After the mixture was subjected to a 10-minute ripening treatment, to the mixture were added a mixture of 200 ml of a 1 mol/l aqueous potassium bromide solution with 50 ml of a 0.1 mol/l aqueous potassium iodide solution. In order to deposit silver chloride shells over the thus obtained conversion type silver chloroiodobromide particles, 150 ml of a 1 mol/l aqueous silver nitrate solution were added spending 5 minutes to the resulting particles, which were then subjected to a 20-minute physical ripening followed by washing, whereby an internal latent image type silver halide emulsion was prepared. The thus procuced internal latent image type silver halide emulsion was divided into three, and one of the three was spectrally sensitized by use of the following dyes (I) and (II) to produce a green-sensitive emulsion; another of the three spectrally sensitized by the addition of dyes (III) and (IV) to produce a red-sensitive emulsion; and further, the remaining one, without being spectrally sensitized, was used, as it was, as a blue-sensitive emulsion.

Dyes

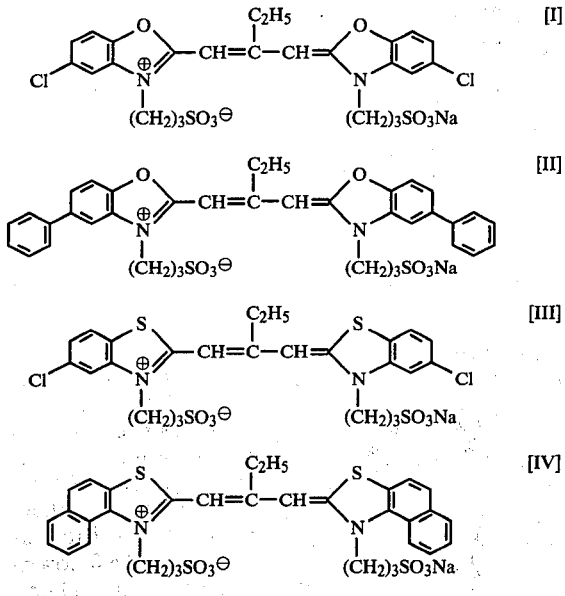

The following layers were coated in order on a resin-coated paper support:

(1) Red-sensitive emulsion layer

Containing the foregoing red-sensitive emulsion and an oil-protect-dispersed cyan coupler 2,4-dichloro-3-methyl-6-[α-(2,4-di-tert-amyl-phenoxy)-butylamide]phenol.

(2) Interlayer

Containing a grey colloidal silver and an oil-protect-dispersed 2,5-di-tert-octyl hydroquinone.

(3) Green-sensitive emulsion layer

Containing the foregoing green-sensitive emulsion and an oil-protect-dispersed magenta coupler 1-(2,4,6-trichlorophenyl)-3-(2-chloro-5-octadecylsuccinimidoanilino)-5-pyrazolone.

(4) Yellow filter layer

Containing an yellow colloidal silver and an oil-protect-dispersed 2,5-di-tert-octyl hydroquinone.

(5) Blue-sensitive emulsion layer

Containing the foregoing blue-sensitive emulsion and an oil-protect-dispersed yellow coupler α-[4-(1-benzyl-2-phenyl-3,5-dioxo-1,2,4-triazolidinyl)]-α-pivalyl-2-chloro-5-[γ-(2,4-di-tert-amylphenoxy)-butylamido]acetanilide.

(6) Protective layer: a gelatin layer

The coated sample, after drying, was divided into pieces, and each of them was exposed through a sensitometric optical wedge to light (hereinafter referred to as "wedge exposure") using a sensitometer. The wedge-exposed pieces were subjected to overall exposure to a 2854° K. tungsten light under the conditions that the pieces are light-fogged with the exposure intensities varied so as to be 2.5 Lux, 5 Lux, 10 Lux and 20 Lux, respectively. And also a light source of 5200° K. obtained by applying a color temperature conversion filter to the tungsten light was used to make overall exposures with the exposure intensities varied so as to be 2.5 Lux, 5 Lux, 10 Lux and 20 Lux, provided, however, the exposure intensities in this case are of the values obtained by measuring without through the color temperature conversion filter. Each of the overall exposures was made for 10 seconds.

Each of the above sample pieces was processed in a developer having the following composition for 5 minutes at 20° C., provided the above-mentioned overall exposure was commenced 20 seconds after the immersion of each piece in the developing liquid.

| | |
|---|---|
| 4-amino-3-methyl-N—ethyl-N—(β-methane-sulfonamidoethyl) aniline sulfate | 5 g |
| Anhydrous sodium sulfite | 2 g |
| Sodium carbonate, monohydrated | 15 g |
| Potassium bromide | 1 g |
| Benzyl alcohol | 10 ml |
| Water to make | 1 liter |

Subsequently, each sample was bleached, fixed, washed and dried in the normal manner. The resulting positive image obtained in each sample was measured for the maximum density (Dmax) and the minimum density (Dmin), the results of which are given in Table 1, in which the final evaluation of the image quality is expressed with the marking O (good) or X (bad).

A part of each of the above samples, without being subjected to wedge exposure, was used to perform a light-intensity scale exposure test in the following manner: The above tungsten light was used as a light source to make overall exposures varying the exposure intensity from 0.1 Lux to 10 Lux. Further, a light source obtained by applying a color temperature conversion filter to the tungsten light also was used to make overall exposures with the exposed intensities varied from 0.1 Lux to 10 Lux. These overall exposures each was made for 10 seconds.

The resulting samples each was developed, bleached, fixed, and washed in the same manner as in the above wedge-exposed samples, provided the light intensity scale exposure was commenced 20 seconds after the immersion of the sample in the developing liquid.

The image densities obtained in the respective samples were measured with the blue light with respect to the yellow image with the green light to the magenta image, and with the red light to the cyan image. The I ½ B, I ½ G, and I ½ R, the exposure intensities necessary to give the ½ of the respective maximum densities in the light-intensity scale exposure test were measured. The results are given in Table 2.

TABLE 1

| | | Maximum density | Minimum density | Evaluation of image quality |
|---|---|---|---|---|
| Light source: tungsten 2854° K. | | | | |
| 2.5 Lux | Blue | 1.70 | 0.16 | X |
| | Green | 2.20 | 0.15 | (Dmax of blue |
| | Red | 2.32 | 0.09 | is small) |
| 5.0 Lux | Blue | 1.86 | 0.17 | X |
| | Green | 2.22 | 0.14 | (Dmax of blue |
| | Red | 2.20 | 0.13 | is small) |
| 10.0 Lux | Blue | 2.16 | 0.18 | X |
| | Green | 2.18 | 0.16 | (Dmin of red |
| | Red | 2.17 | 0.24 | is large) |
| 20.0 Lux | Blue | 2.15 | 0.18 | X |
| | Green | 2.02 | 0.17 | (Dmin of red |
| | Red | 1.93 | 0.28 | is large) |
| Light source: tungsten 5200° K. | | | | |
| 2.5 Lux | Blue | 1.05 | 0.15 | X |
| | Green | 1.23 | 0.13 | (Dmax of blue, |
| | Red | 1.68 | 0.07 | green & red are small) |
| 5.0 Lux | Blue | 1.65 | 0.17 | X |
| | Green | 1.97 | 0.14 | (Dmax of blue |
| | Red | 2.30 | 0.09 | and green are small) |
| 10.0 Lux | Blue | 2.15 | 0.18 | O |
| | Green | 2.22 | 0.14 | |
| | Red | 2.32 | 0.09 | |
| 20.0 Lux | Blue | 2.17 | 0.18 | O |
| | Green | 2.24 | 0.14 | |
| | Red | 2.28 | 0.10 | |

TABLE 2

| Light source: tungsten | I ½B | I ½G | I ½R | Remarks |
|---|---|---|---|---|
| 2854° K. | 1.78 Lux | 0.58 Lux | 0.25 Lux | Out of the invention |
| 5200° K. | 2.40 Lux | 1.95 Lux | 1.26 Lux | The invention |

In Table 2, in the case of 2854° K., $$\frac{1}{6} > \frac{I\,\frac{1}{2}\,R}{I\,\frac{1}{2}\,B} = \frac{0.25}{1.78}$$

and this does not satisfy the foregoing formula (3), thus being out of the present invention. On the other hand, in the case of 5200° K., $$\frac{1}{6} \leqq \frac{I\,\frac{1}{2}\,B}{I\,\frac{1}{2}\,G} = \frac{2.40}{1.95} \leqq 6$$

$$\frac{1}{6} \leqq \frac{I\,\frac{1}{2}\,G}{I\,\frac{1}{2}\,R} = \frac{1.95}{1.26} \leqq 6$$

$$\frac{1}{6} \leqq \frac{I\,\frac{1}{2}\,R}{I\,\frac{1}{2}\,B} = \frac{1.26}{2.40} \leqq 6$$

and the results satisfy all the foregoing formulas (1), (2) and (3), thus being within the present invention.

As apparent from Table 1, in the case where overall exposures were made using the light source of 2854° K. which is out of the invention, though the illuminances of the overall exposures were varied from 2.5 Lux to 20 Lux, any satisfactory image was not obtained at all, whereas where the light source of 5200° K. which is within the present invention was used, satisfactory images having sufficiently large maximum and minimum densities under the conditions of 10 Lux and 20 Lux were obtained.

In addition, the exposures under the conditions of 10 Lux and 20 Lux in the case of 5200° K. which enabled to obtain satisfactory image qualities, when the exposure intensities necessary to give 80% densities of the respective maximum densities in the light-intensity scale exposure test obtained by measuring with the blue light to the yellow image, with the green light to the magenta image, and with the red light to the cyan image are regarded as $I_{0.8}B$, $I_{0.8}G$, and $I_{0.8}R$, respectively, were found out to be contained in the interval common to the interval between $I_{0.8}B$ and $10\times I_{0.8}B$, the interval between $I_{0.8}G$ and $10\times I_{0.8}G$, and the interval between $I_{0.8}R$ and $10\times I_{0.8}R$.

EXAMPLE 2

The samples obtained in Example 1 were subjected to wedge exposures by means of a sensitometer, and then subjected to overall exposures to a white fluorescent light, varying the exposure intensity so as to be 2.5 Lux, 5 Lux, 10 Lux, and 20 Lux. And further, overall exposures were made through each of color compensating magenta filters whose green densities are 0.3, 0.6, 1.0, and 1.3 to the foregoing white fluorescent light by varying the exposure intensity so as to be 2.5 Lux, 5 Lux, 10 Lux and 20 Lux, provided, however, the exposure intensities are of the value obtained by measuring without through the color compensating filters. Each of the overall exposures was made for 8 seconds.

These samples each was developed, bleached, fixed, and washed in the same manner as in Example 1. The positive image obtained in each sample was measured for the maximum and minimum densities thereof and the results are shown in Table 3, in which the final evaluations for the image qualities also are given.

On the other hand, unexposed samples were used to make light-intensity scale exposure tests in the same manner as in Example 1, provided the white fluorescent light was used as a light source for the overall exposures with the exposure intensities varied from 0.2 Lux to 20 Lux. And further, the unexposed samples were used to make different light-intensity scale exposure tests with the exposure through each of the color compensating magenta filters whose green densities are 0.3, 0.6, 1.0 and 1.3 to the foregoing white fluorescent light with the exposure intensities varied in the same way from 0.2 Lux to 20 Lux. Each of the overall exposures was made for 8 seconds.

These samples each was developed, bleached, fixed, and washed in the same manner as in Example 1. The image obtained in each sample was measured in the same manner as in Example 1 for the I ½ B, I ½ G, and I ½ R. The results are given in Table 4.

TABLE 3

| Magenta filter | | | Maximum density | Minimum density | Evaluation of image quality |
|---|---|---|---|---|---|
| None | 2.5 Lux | Blue | 0.92 | 0.16 | X |
| | | Green | 2.25 | 0.14 | (Dmax of blue |
| | | Red | 1.67 | 0.08 | and red are small) |
| | 5.0 Lux | Blue | 1.52 | 0.17 | X |
| | | Green | 2.21 | 0.15 | (Dmax of blue |
| | | Red | 2.30 | 0.09 | is small) |
| | 10.0 Lux | Blue | 2.12 | 0.18 | X |
| | | Green | 2.18 | 0.25 | (Dmin of |
| | | Red | 2.27 | 0.09 | green is large) |
| | 20.0 Lux | Blue | 2.15 | 0.18 | X |
| | | Green | 2.10 | 0.34 | (Dmin of |
| | | Red | 2.24 | 0.14 | green and red are large) |
| 0.3 | 2.5 Lux | Blue | 0.83 | 0.16 | X |
| | | Green | 2.23 | 0.14 | (Dmax of blue |
| | | Red | 1.67 | 0.08 | & red are small) |
| | 5.0 Lux | Blue | 1.42 | 0.17 | X |
| | | Green | 2.25 | 0.14 | (Dmax of blue |
| | | Red | 2.33 | 0.09 | is small) |
| | 10.0 Lux | Blue | 2.10 | 0.18 | O |
| | | Green | 2.21 | 0.14 | |
| | | Red | 2.31 | 0.09 | |
| | 20.0 Lux | Blue | 2.15 | 0.18 | X |
| | | Green | 2.13 | 0.34 | (Dmin of |
| | | Red | 2.30 | 0.10 | green is large) |
| 0.6 | 2.5 Lux | Blue | 0.72 | 0.16 | X |
| | | Green | 1.53 | 0.15 | (Dmax of blue, |
| | | Red | 1.65 | 0.08 | green & red are small) |
| | 5.0 Lux | Blue | 1.38 | 0.17 | X |
| | | Green | 2.25 | 0.14 | (Dmax of blue |
| | | Red | 2.29 | 0.09 | is small) |
| | 10.0 Lux | Blue | 2.13 | 0.18 | O |
| | | Green | 2.27 | 0.14 | |
| | | Red | 2.31 | 0.09 | |
| | 20.0 Lux | Blue | 2.15 | 0.18 | O |
| | | Green | 2.26 | 0.14 | |
| | | Red | 2.28 | 0.09 | |
| 1.0 | 2.5 Lux | Blue | 0.52 | 0.16 | X |
| | | Green | 0.72 | 0.13 | (Dmax of blue, |
| | | Red | 1.60 | 0.09 | green & red are small) |
| | 5.0 Lux | Blue | 1.12 | 0.17 | X |
| | | Green | 1.34 | 0.14 | (Dmax of blue |
| | | Red | 2.25 | 0.08 | & green are small) |
| | 10.0 Lux | Blue | 2.12 | 0.18 | O |
| | | Green | 2.22 | 0.14 | |
| | | Red | 2.30 | 0.09 | |
| | 20.0 Lux | Blue | 2.17 | 0.18 | O |
| | | Green | 2.26 | 0.14 | |
| | | Red | 2.25 | 0.10 | |
| 1.3 | 2.5 Lux | Blue | 0.44 | 0.17 | X |
| | | Green | 0.31 | 0.10 | (Dmax of blue, |
| | | Red | 1.37 | 0.07 | green & red are small) |
| | 5.0 Lux | Blue | 1.14 | 0.17 | X |
| | | Green | 0.75 | 0.12 | (Dmax of blue |
| | | Red | 2.30 | 0.09 | & green are small) |
| | 10.0 Lux | Blue | 2.18 | 0.18 | X |
| | | Green | 1.35 | 0.13 | (Dmax of |
| | | Red | 2.19 | 0.10 | green is small) |
| | 20.0 Lux | Blue | 2.16 | 0.18 | X |
| | | Green | 2.16 | 0.14 | (Dmin of red |
| | | Red | 2.16 | 0.23 | is large) |

TABLE 4

| Density of magenta filter | I ½ B (Lux) | I ½ G (Lux) | I ½ R (Lux) | Remarks |
|---|---|---|---|---|
| No filter | 2.82 | 0.33 | 1.12 | Out of the |

TABLE 4-continued

| Density of magenta filter | I ½ B (Lux) | I ½ G (Lux) | I ½ R (Lux) | Remarks |
|---|---|---|---|---|
| | | | | invention |
| 0.3 | 3.24 | 0.72 | 1.20 | The invention |
| 0.6 | 3.72 | 1.35 | 1.29 | The invention |
| 1.0 | 4.37 | 3.98 | 1.35 | The invention |
| 1.3 | 4.89 | 8.57 | 1.39 | Out of the invention |

As apparent from Table 3, it is understood that where the overall exposure was made through one of the magenta filters having densities of 0.3, 0.6 and 1.0, by the selection of an appropriate exposure intensity a satisfactory photograhic image having sufficiently large maximum and minimum densities can be obtained. In addition, it has been found that the exposure intensities under the conditions of 10 Lux in the magenta filter with the density of 0.3, of 10 Lux and 20 Lux in the magenta filter with the density of 0.6, and of 10 Lux and 20 Lux in the magenta filter with the density of 1.0, in their respective conditions, are all contained in the interval common to the interval between $I_{0.8}B$ and $10\times I_{0.8}B$, the interval between $I_{0.8}G$ and $10\times I_{0.8}G$, and the interval between $I_{0.8}R\times I_{0.8}R$.

EXAMPLE 3

The same procedures as in Example 1 took place with the exception that as the blue-sensitive emulsion an internal latent image type silver halide that was prepared in the manner give below was used.

To 100 ml of an aqueous gelatin solution containing 5 g of gelatin were added at 60° C. at the same time 200 ml of a 1.1 mol/l aqueous potassium chloride solution together with 200 ml of a 1 mol/l aqueous silver nitrate solution spending 20 minutes, and then the mixture was subjected to a 10-minute physical ripening treatment, to which was subsequently added a mixture of 200 ml of a 1 mol/l aqueous potassium bromide solution with 50 ml of a 0.1 mol/l aqueous potassium iodide solution. In order to deposit silver chloride shells over the resulting conversion type silver chloroiodobromide particles, 150 ml of a 1 mol/l aqueous silver nitrate solution was added spending 5 minutes to the emulsion, which was then subjected to a 20-minute physical ripening treatment and then washed, whereby an internal latent image type silver halide emulsion was prepared. The thus produced emulsion was used as a blue-sensitive emulsion without being spectrally sensitized.

The obtained samples were subjected to wedge exposures in the same manner as Example 1, and then a part of the samples was subjected to overall exposures to a 2854° K. tungsten light and the other was subjected to overall exposures to a 5200° K. light that was obtained by applying to a color temperature conversion filter to the tungsten light.

Each of the samples was developed, bleached, fixed, and washed in the same manner as in Example 1, and the resulting positive image was measured for the maximum and minimum densities thereof. The results obtained are as shown in Table 5, in which final evaluations for the image qualities also are shown.

Part of the obtained samples was used to make light-intensity scale exposure tests in the same manner as in Example 1. The image obtained in each sample was measured for the I ½ B, I ½ G, and I ½ R. The results of the test are as given in Table 6.

TABLE 5

| Light source | | | Maximum density | Minimum density | Evaluation of image quality |
|---|---|---|---|---|---|
| Tungsten 2854° K. | | | | | |
| | 2.5 Lux | Blue | 2.13 | 0.17 | O |
| | | Green | 2.24 | 0.14 | |
| | | Red | 2.33 | 0.10 | |
| | 5.0 Lux | Blue | 2.10 | 0.19 | O |
| | | Green | 2.25 | 0.14 | |
| | | Red | 2.30 | 0.10 | |
| | 10.0 Lux | Blue | 2.01 | 0.27 | X |
| | | Green | 2.22 | 0.14 | (Dmax of blue |
| | | Red | 2.20 | 0.19 | & red are large) |
| | 20.0 Lux | Blue | 1.89 | 0.34 | X |
| | | Green | 2.17 | 0.22 | (Dmin of blue |
| | | Red | 2.12 | 0.27 | green & red are large) |
| Tungsten plus color temperature conversion filter 5200° K. | | | | | |
| | 2.5 Lux | Blue | 2.12 | 0.17 | X |
| | | Green | 1.22 | 0.14 | (Dmax of |
| | | Red | 1.70 | 0.09 | green & red are small) |
| | 5.0 Lux | Blue | 2.10 | 0.18 | X |
| | | Green | 1.79 | 0.13 | (Dmax of |
| | | Red | 2.32 | 0.09 | green is small) |
| | 10.0 Lux | Blue | 2.02 | 0.27 | X |
| | | Green | 2.24 | 0.14 | (Dmin of blue |
| | | Red | 2.27 | 0.09 | is large) |
| | 20.0 Lux | Blue | 1.89 | 0.34 | X |
| | | Green | 2.25 | 0.15 | (Dmin of blue |
| | | Red | 2.31 | 0.09 | is large) |

TABLE 6

| Light source | I ½ B | I ½ G | I ½ R | Remarks |
|---|---|---|---|---|
| 2854° K. | 0.20 Lux | 0.56 Lux | 0.25 Lux | The invention |
| 5200° K. | 0.29 Lux | 2.14 Lux | 1.23 Lux | Out of the invention |

As apparent from the above results, it is understood that in Example 3 where a different light-sensitive material than that of Example 1 was used, the tungsten light of 2854° K. is included in the present invention unlike in Example 1, and by selecting an appropriate intensity of overall exposure to the light of 2854° K. a satisfactory photographic image having sufficiently large maximum and small minimum densities can be obtained. From this fact, it is understood that in the case where the light-sensitive material is changed, the energy distribution of the exposure that is capable of producing a satisfactory image quality also changes according to the change, and any method other than that of the present invention cannot produce as much satisfactory an image as in the present invention.

In addition, the 2.5 Lux and 5 Lux in the 2854° K. under the conditions of which satisfactory images were obtained are contained in the common interval to the internal between $I_{0.8}B$ and $10\times I_{0.8}B$, the interval between $I_{0.8}G$ and $10\times I_{0.8}G$, and the interval between $I_{0.8}R$ and $10\times I_{0.8}R$.

What is claimed is:

1. A method for the formation of direct positive images wherein a silver halide light-sensitive color two silver halide emulsion layers having different spectral sensitivities coated thereon, said silver halide emulsion being an internal latent image type containing unfogged silver halide crystals, comprising imagewise exposing said photographic material and subsequently subjecting said material to an overall area exposure prior to or during the development thereof to form a direct positive image, wherein said overall area exposure is such that the photographic intensity ratios among said silver halide emulsion layers are not more than six, and the intensity of the overall area exposure has a value between a light intensity value yielding 0.8 times the maximum image density of an emulsion layer, and 10 times of said light intensity value, wherein said photographic intensity ratio is the ratio between photographic intensities of two emulsion layers and said photographic intensity is the reciprocal of the intensity value that corresponds to an image density which is 50% of the maximum when an imagewise-unexposed internal latent type silver halide emulsion layer is subjected to light-intensity scale exposure and the density of the image formed by said layer is measured with a light corresponding to the absorption maximum of the image.

2. A method for the formation of a direct positive image according to claim 1 wherein said light intensity value of overall area exposure exists in the common interval of the light intensity intervals of silver halide emulsion layers.

3. A method for the formation of a direct positive image according to claim 1 wherein said photographic intensity ratios of said overall area exposure among said silver halide emulsion layers are respectively not more than four.

4. A method for the formation of a direct positive image according to claim 1 wherein the intensity of the overall area exposure has the value between the light intensity value interval which gives 0.8 times of the maximum image density of an emulsion layer and 6 times of said light intensity value.

5. A method for the formation of a direct positive image according to claim 1 wherein said silver halide color photographic material comprising an yellow image forming blue-sensitive silver halide emulsion layer, a magenta image forming green-sensitive silver halide emulsion layer, and a cyan image forming red-sensitive silver halide emulsion layer.

6. A method for the formation of a direct positive image according to claim 1 wherein said unfogged silver halide crystal is such that the density obtained by processing without exposing to light a test piece prepared by coating on a transparent support the emulsion containing said crystals so that the coating amount is 35 mg $Ag/dm^2$ in a surface developer having the following composition for 10 minutes at 20° C. does not exceed 0.6.

| | |
|---|---|
| Metol | 2.5 g |
| 1-Ascorbic acid | 10 g |
| NaBO—4HO | 35 g |
| KBr | 1 g |
| Water to make | 1 liter |

7. A method for the formation of a direct positive image according to claim 1 wherein said internal latent image type silver halide emulsion shows, when a test piece prepared by coating on a transparent support the emulsion so that the coated silver amount is 35 mg $Ag/dm^2$ is exposed to light in a light-intensity scale for a given period of up to 1 second and processed in said surface developer for 4 minutes at 20° C., such maximum density that is not greater than 1/5 of the maximum density obtained by subjecting another part of the test piece to exposure in the same manner and to the development with an internal developer having the following composition for 4 minutes at 20° C.

| | |
|---|---|
| Metol | 2 g |
| Sodium sulfite (anhydrous) | 90 g |
| Hydroquinon | 8 g |
| Sodium carbonate (monohydrate) | 52.5 g |
| KBr | 5 g |
| KI | 0.5 g |
| Water to make | 1 liter |

8. A method for the formation of a direct positive image according to claim 5 wherein said internal latent image type silver halide emulsion shows, when a test piece prepared by coating on a transparent support the emulsion so that the coated silver amount is 35 mg $Ag/dm^2$ is exposed to light in a light-intensity scale for a given period of up to 1 second and processed in said surface developer for 4 minutes at 20° C., such maximum density that is not greater than 1/5 of the maximum density obtained by subjecting another part of th test piece to exposure in the same manner and to the development with an internal developer having following composition for 4 minutes at 20° C.

| | |
|---|---|
| Methol | 2 g |
| Sodium sulfite (anhydrous) | 90 g |
| Hydroquinon | 8 g |
| Sodium carbonate (monohydrate) | 52.2 g |
| KBr | 5 g |
| KI | 0.5 g |
| Water to make | 1 liter |

* * * * *

UNITED STATES PATENT AND TRADEMARK OFFICE

CERTIFICATE OF CORRECTION

PATENT NO. : 4,440,851

DATED : April 3, 1984

INVENTOR(S) : Tosaka, et al

It is certified that error appears in the above-identified patent and that said Letters Patent are hereby corrected as shown below:

Claim 1, line 2, after "color" there should be inserted --photographic material having a support and at least--.

Signed and Sealed this

Seventeenth Day of February, 1987

*Attest:*

DONALD J. QUIGG

*Attesting Officer*

*Commissioner of Patents and Trademarks*